US011365946B2

(12) United States Patent
Lawrie

(10) Patent No.: US 11,365,946 B2
(45) Date of Patent: Jun. 21, 2022

(54) LOCKING ASSEMBLY FOR FIREARM TRIGGER SAFETY MECHANISMS

(71) Applicant: David Lawrie, Crozet, VA (US)

(72) Inventor: David Lawrie, Crozet, VA (US)

(73) Assignee: MACHINE INC, Crozet, VA (US)

( * ) Notice: Subject to any disclaimer, the term of this patent is extended or adjusted under 35 U.S.C. 154(b) by 0 days.

(21) Appl. No.: 17/150,043

(22) Filed: Jan. 15, 2021

(65) Prior Publication Data

US 2022/0034613 A1 Feb. 3, 2022

Related U.S. Application Data

(63) Continuation-in-part of application No. 16/983,467, filed on Aug. 3, 2020.

(51) Int. Cl.
*F41A 17/06* (2006.01)

(52) U.S. Cl.
CPC ..... *F41A 17/063* (2013.01)

(58) Field of Classification Search
CPC ..... F41A 17/063; F41A 17/06; F41A 17/46; F41A 17/48
See application file for complete search history.

(56) References Cited

U.S. PATENT DOCUMENTS 5,448,847 A * 9/1995 Teetzel ..... F41A 17/066 42/70.05
5,896,691 A * 4/1999 Kaminski ..... F41A 17/08 42/70.11
8,893,420 B2 * 11/2014 Milde, Jr. ..... F41A 17/066 42/70.06
9,222,740 B1 * 12/2015 Milde, Jr. ..... F41A 17/066
9,377,259 B2 * 6/2016 Milde, Jr. ..... F41A 17/066
9,395,133 B2 * 7/2016 Milde, Jr. ..... G07C 9/00174
9,726,448 B1 * 8/2017 Milde, Jr. ..... F41A 17/066
9,739,555 B2 * 8/2017 Milde, Jr. ..... F41A 17/44
9,879,932 B2 * 1/2018 Milde, Jr. ..... F41A 17/46
10,113,823 B2 * 10/2018 Alicea, Jr. ..... F41A 17/20
10,746,490 B1 * 8/2020 Yu ..... F41A 17/063
2014/0215881 A1 * 8/2014 Milde, Jr. ..... G07C 9/00896 42/70.06
2015/0068093 A1 * 3/2015 Milde, Jr. ..... F41A 17/063 42/70.11

(Continued)

*Primary Examiner* — Jonathan C Weber

(57) ABSTRACT

A system for improving firearm safety is provided comprising a firearm comprising a trigger mechanism for discharging the firearm, a trigger safety member to prevent accidental discharging of the firearm, and an electronic housing contained in a pistol grip of the firearm. The housing receives a message from a mobile device, determines that the message contains an instruction associated with an owner of the firearm, and transmits, based on the instruction, a command regarding the trigger safety member. The electronic housing transmits the command along an internal cable to a motor embedded in the trigger mechanism and receives the message via a transceiver component of the electronic housing. The motor, based on the command, turns an eccentric component to one of block and unblock the trigger safety member. The electronic housing further comprises an externally visible LED indicating one of engaged and disengaged status of the eccentric component.

20 Claims, 8 Drawing Sheets

(56) References Cited

U.S. PATENT DOCUMENTS

| | | | | |
|---|---|---|---|---|
| 2015/0184965 | A1* | 7/2015 | Milde, Jr. | F41A 35/00<br>42/70.06 |
| 2016/0273859 | A1* | 9/2016 | Milde, Jr. | F41A 17/22 |
| 2016/0327356 | A1* | 11/2016 | Milde, Jr. | F41A 17/44 |
| 2017/0227315 | A1* | 8/2017 | Milde, Jr. | F41A 35/00 |
| 2018/0224231 | A1* | 8/2018 | Weinberg | F41A 17/42 |
| 2019/0219351 | A1* | 7/2019 | Weinberg | F41G 11/003 |
| 2019/0226785 | A1* | 7/2019 | Delgado Acarreta | F41A 17/06 |
| 2020/0386503 | A1* | 12/2020 | Moretti | F41A 17/52 |

* cited by examiner

LOCKING ASSEMBLY FOR FIREARM TRIGGER SAFETY MECHANISMS

CROSS REFERENCE TO RELATED APPLICATIONS

The present application is a Continuation-In-Part of U.S. non-provisional patent application Ser. No. 16/983,467 filed Aug. 3, 2020, the contents of which are incorporated herein in full.

FIELD OF THE INVENTION

The present disclosure is in the field of firearm safety. More particularly, the present disclosure teaches systems and methods of blocking a trigger safety mechanism of a firearm such that the mechanism cannot be moved and the firearm thus unable to be discharged.

BACKGROUND

Gun safety rules and practice recommendations are intended to avoid accidental and unauthorized discharge or negligent discharge, or the consequences of firearm malfunctions. Their purpose is to eliminate or minimize the risks of unintentional death, injury or property damage caused by improper possession, storage or handling of firearms.

A locking safety mechanism or safety is a component of the trigger assembly in many popular handguns. The safety mechanism stops the gun from being fired without the user first manipulating a component which disengages the safety mechanism so the gun can fire. In many popular models, the safety is alongside the trigger such that once the safety is pulled, the trigger alongside the safety can then be pulled and the firearm discharged.

In many handguns, the safety is immediately adjacent the trigger. A user wishing to fire the weapon pulls the safety, deactivating it, and pulls the adjacent trigger, discharging the weapon.

DETAILED DESCRIPTION

Figure 1:
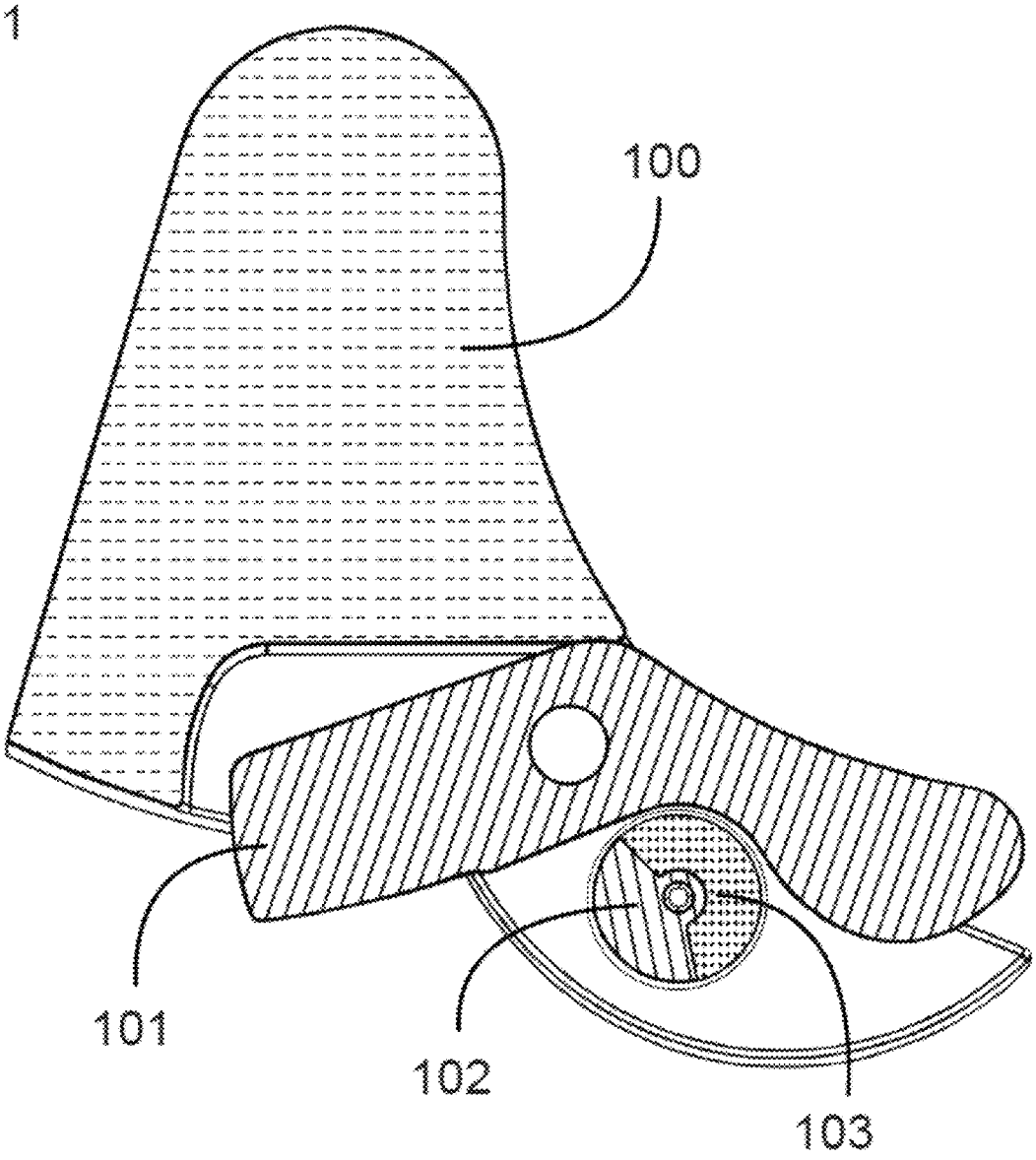
FIG. 1 is a diagram of a locking assembly for firearm trigger safety mechanisms according to an embodiment of the present disclosure.

The present disclosure is directed to firearm safety and to supplement existing methods for securing a trigger safety mechanism or safety of a firearm. A locking assembly provided herein interferes with the safety engage/disengage process by moving and inserting a mechanical stop or eccentric into the path of the safety. The safety consequently cannot be pulled and therefore released and the trigger hence not accessible. The risk of accidental or unauthorized discharge of the firearm is thus reduced.

The process of unlocking and locking the safety as provided herein may be controlled electronically via an application or app on a mobile device such as a mobile phone. A user of the device can configure the app such that once the firearm and the mobile device are more than a predetermined distance from one another, the eccentric is moved into position causing the safety to be blocked and the firearm no longer able to fire.

The locking assembly provided herein comprises the eccentric and a small motor embedded in or near the trigger. The motor moves the eccentric forward and backward. Each such movement of lock or unlock, respectively, causes the eccentric to be secured in place by a spring which rests in a small cut out groove of the eccentric. A power source for moving the eccentric and electronic parts are also local.

The eccentric and motor, when in forward and locked position with the eccentric secured in place, prevents the safety from being moved and therefore released. The trigger cannot be pulled, and the gun therefore cannot be fired.

The locking assembly comprising eccentric and motor may attach to or be embedded into the trigger. The eccentric is semi-circular in shape and turns on an axis perpendicular to the direction of the trigger's movement. The motor turns the eccentric into position to block the safety from being released.

Once the eccentric is in forward position and held there, the safety is blocked and cannot be moved. Conversely, when the firearm is to be discharged or be otherwise readied for firing, the motor turns the eccentric backward such that it no longer blocks the safety. The safety can be pulled, releasing it, and thereafter the trigger can be accessed and the firearm discharged.

The motor contained in the locking assembly is remotely controlled by the mobile device and a programmable application executing thereon. The motor may receive instructions via a locally operating transceiver. The application is password protected and allows the user to configure a distance from the firearm wherein the locking assembly is enabled or disabled, hence blocking or unblocking, respectively, movement of the safety mechanism.

When the mobile device detects that the firearm is within the configured distance, the motor moves the eccentric out of blocking position. The safety may then be released and the weapon may be fired.

Should the weapon and mobile device be moved beyond the predetermined distance from each other, the motor may automatically move the eccentric into position, blocking movement of the safety, and preventing accidental or unauthorized discharge of the weapon.

Systems and methods also provide for the locking mechanism to be engaged and the firearm disabled even if the firearm and the mobile device are together or otherwise within the predetermined distance. In an embodiment involving an emergency and prevention of a possible tragedy, a user may have placed the firearm and the mobile device together in an item of luggage, for example. The user in this example may misplace the luggage or discover that the luggage has been stolen.

The present disclosure provides for the user to remotely and with minimal delay access an Internet web site from a browser or a toll-free number from a telephone and order immediate disabling of the firearm via activation of the locking mechanism. This action thus overrides the functionality described above regarding disabling and enabling the firearm based on the predetermined distance and therefore allows the possibility of a tragedy to be circumvented.

Turning to the figures, FIG. 1 is a diagram of a system of the locking assembly as provided herein. A trigger mechanism 100 or trigger 100 is shown which effectively hosts a safety mechanism 101 or safety 101. The safety 101 rotates or is moved on an axis that is attached to the trigger mechanism 100. The components of the locking assembly are also physically hosted by the trigger mechanism 100.

An eccentric 102 is a semicircular component that turns on an axis. In FIG. 1, the eccentric 102 is shown in disengaged position such that the safety 101 can be moved and the firearm able to be discharged. In FIG. 1, the safety 101 is shown in engaged position because it must be pulled for the trigger 101 to be pulled. But because the eccentric 102 is not engaged, i.e. it is in a position away from the safety 101, the safety 101 can be pulled and the trigger 100 thereafter can be engaged, discharging the firearm.

FIG. 1 also depicts the motor 103. The eccentric 102 remains in place after the eccentric 102 has been moved by the motor 103 in accordance with instructions from the mobile device.

Figure 2:
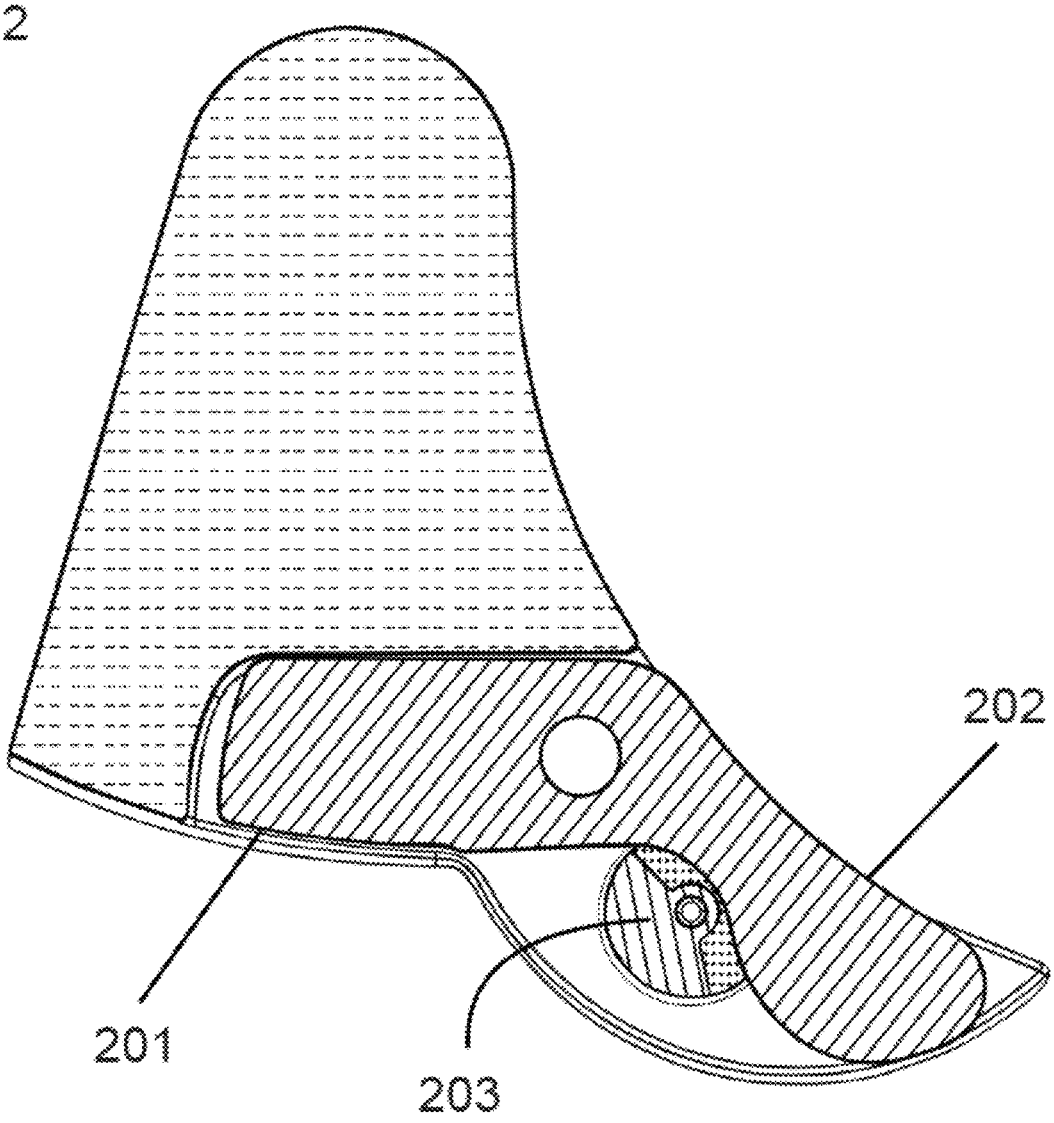
FIG. 2 is a diagram of a locking assembly for firearm trigger safety mechanisms according to an embodiment of the present disclosure.

FIG. 2 is a diagram of a system of the locking assembly as provided herein. Component 202 is not a physical component but rather represents the process of the safety being pushed downward which will move the other end of the safety into the trigger cavity where component 201 is directed. Because the mechanism (the eccentric 203) is in non-engaged position, the safety can be depressed which allows the trigger to be accessed and the firearm to be discharged.

Figure 3:
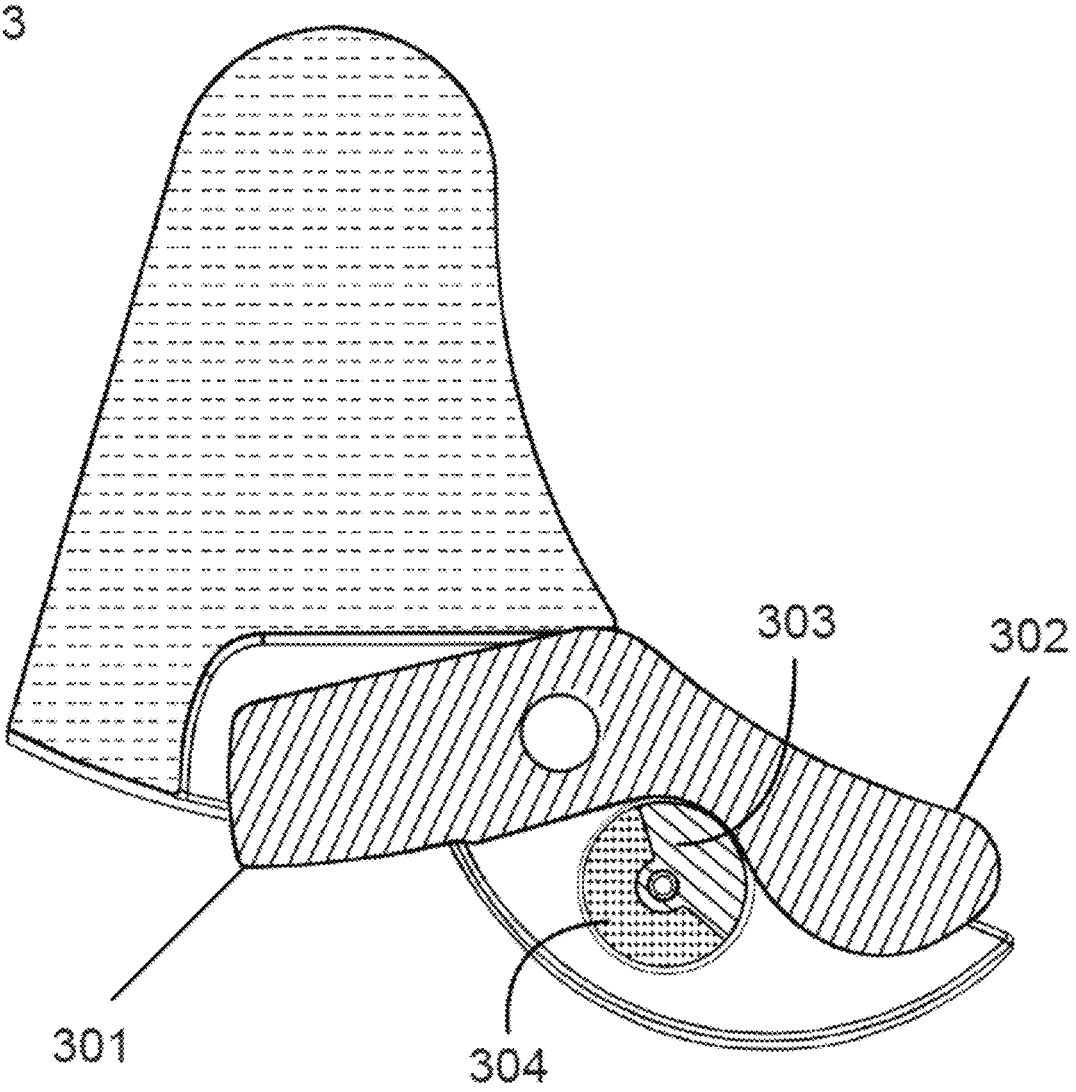
FIG. 3 is a diagram of a locking assembly for firearm trigger safety mechanisms according to an embodiment of the present disclosure.

FIG. 3 is a diagram of the locking assembly with the eccentric 303 having been rotated into locked position by the motor 304 and held there. The safety is shown in engaged and locked position. Component 302 is not a physical component but as above is rather the action of the safety being pushed downward which cannot take place, in contrast to FIG. 2 described above, because of the positioning of the eccentric 303 as described herein. The other end of the safety is shown as component 301 depicting the safety in exposed and engaged position such that the firearm cannot be discharged.

Figure 4:
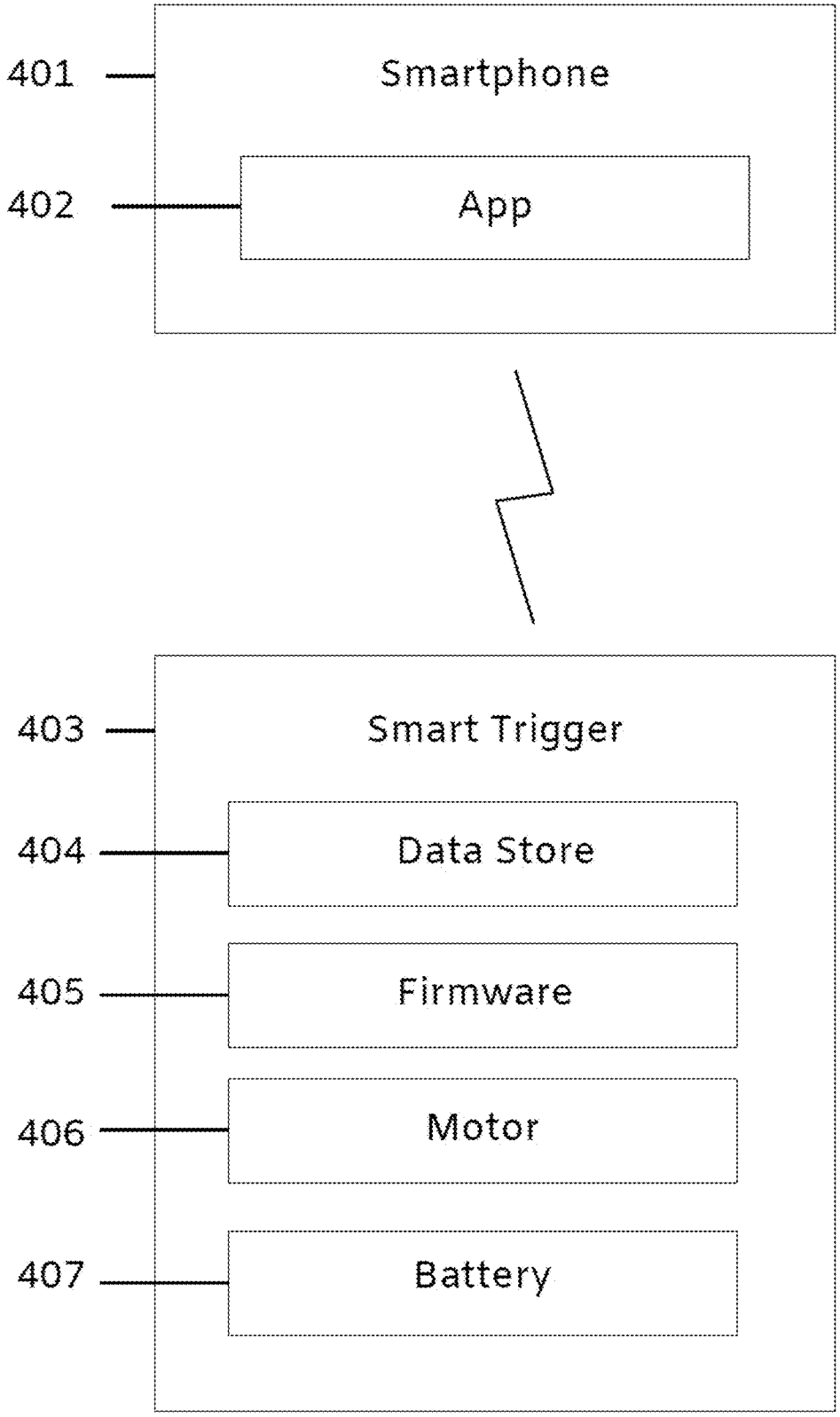
FIG. 4 is a flowchart logical diagram of a locking assembly for firearm trigger safety mechanisms according to an embodiment of the present disclosure.

FIG. 4 is a diagram of the system of a locking mechanism. FIG. 4 depicts a mobile device, a smartphone 401 on which an app 402 is executing. The app 402 is used to configure the distance described above within which the locking mechanism might automatically unlock and make firearm able to be discharged.

FIG. 4 also depicts a smart trigger 403 which refers to the locking mechanism described above. The smart trigger 403 includes a data store 404 which stores configuration information entered by a user. The smart trigger 403 includes firmware 405, which may at least in part be non-volatile software instructions as to when and how the eccentric described above is to be moved. The smart trigger 403 further includes a motor 406, described above, and a battery 407 that provides power to the motor 406.

Figure 5:
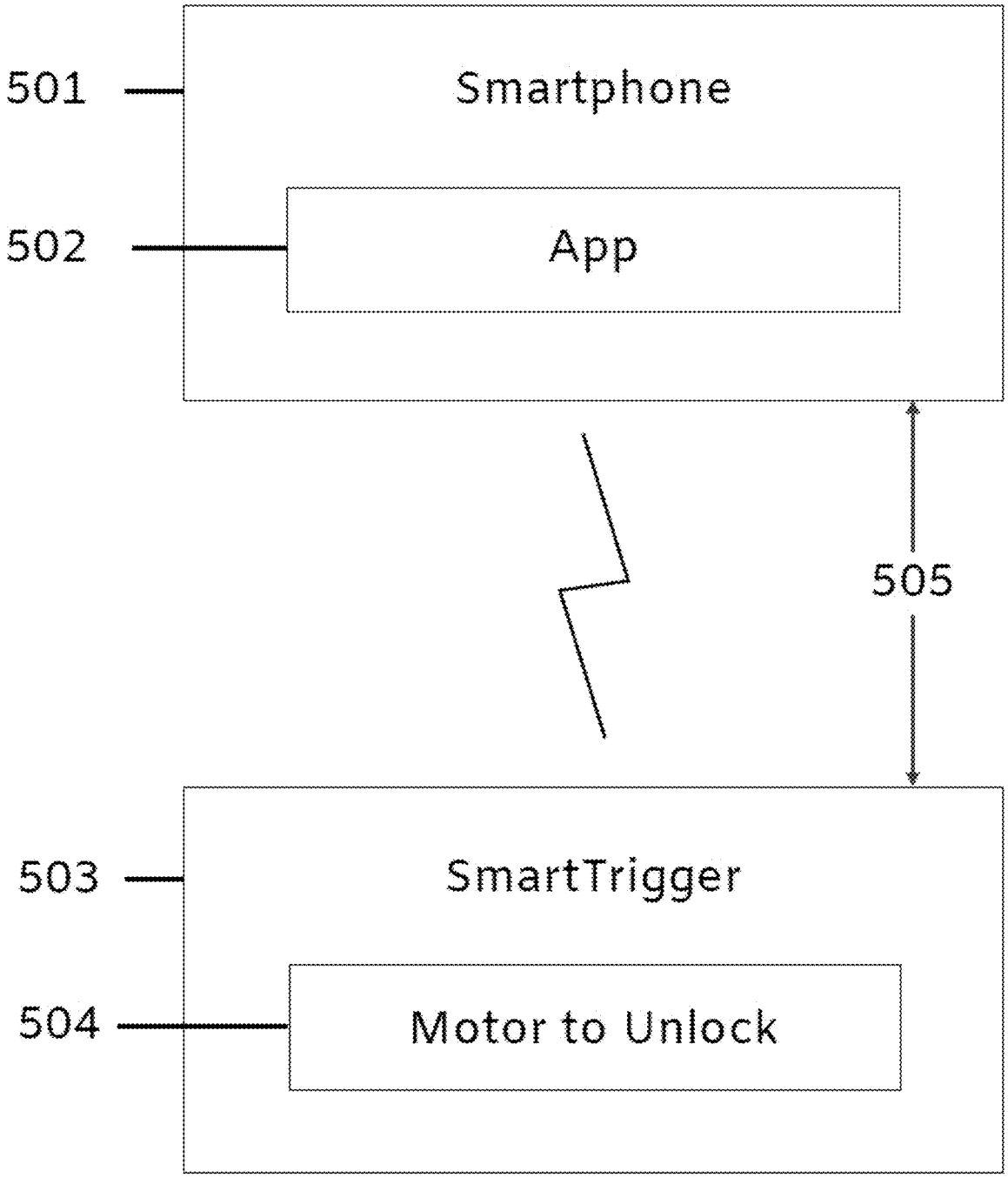
FIG. 5 is a flowchart logical diagram of a locking assembly for firearm trigger safety mechanisms according to an embodiment of the present disclosure.

FIG. 5 is another diagram of the system of locking mechanism described herein. FIG. 5 depicts a smartphone 501 and an app 502 described above that communicate wirelessly with a smart trigger 503 and a motor to unlock 504 also described above. A distance 505 is also depicted which represents a physical amount of space between the smartphone 501 and the smart trigger 503. The distance 505 is relatively small, suggesting that the motor to unlock 504 may unlock the eccentric as described above.

Figure 6:
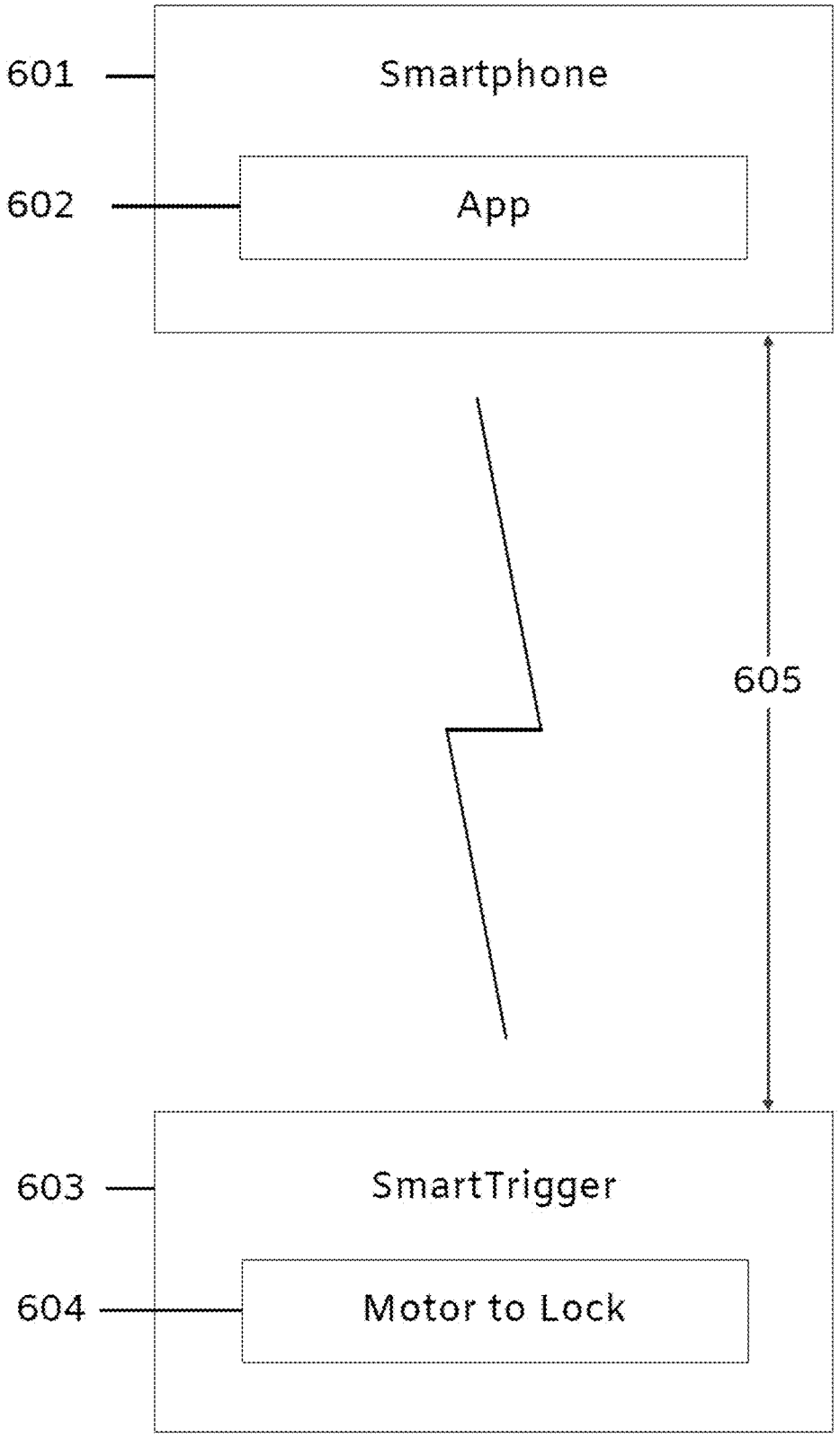
FIG. 6 is a flowchart logical diagram of a locking assembly for firearm trigger safety mechanisms according to an embodiment of the present disclosure.

FIG. 6 is another diagram of the system of locking mechanism described herein. FIG. 6 depicts a smartphone 601 and an app 602 described above that communicate wirelessly with a smart trigger 603 and a motor to unlock 604 also described above. A distance 605 is also depicted which represents a physical amount of space between the smartphone 601 and the smart trigger 603. The distance 605 is relatively greater than the distance 505 shown in FIG. 5, suggesting that the motor to unlock 504 may lock the eccentric as described above.

Figure 7:
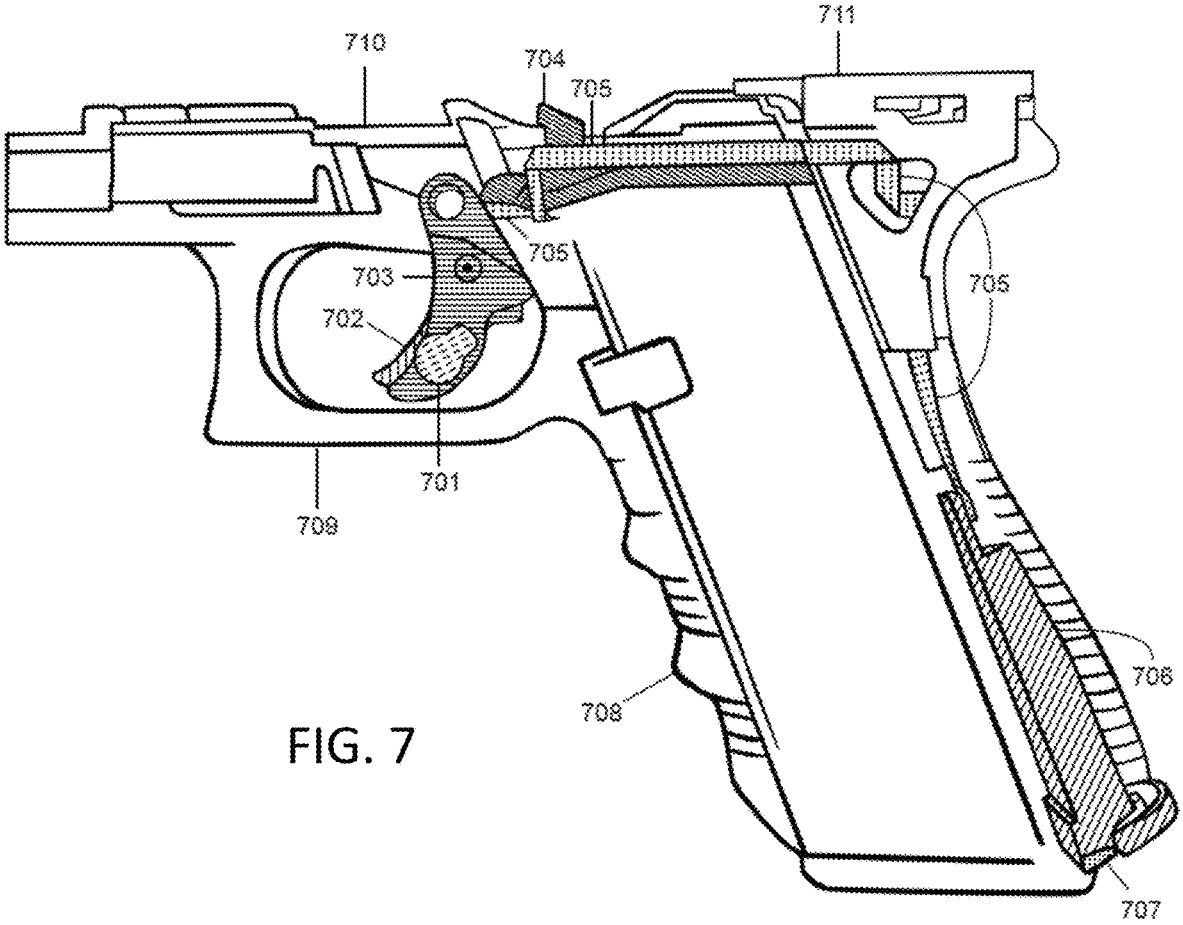
FIG. 7 is a diagram of a locking assembly for firearm trigger safety mechanisms according to an embodiment of the present disclosure.

In an embodiment, an electronics housing or module may be provided. The module, which may be situated primarily in a pistol grip area of a handgun, comprises the transceiver described above and other components that support handgun safety. FIG. 7 depicts such housing and other components whose functionality aligns with components described above and depicted in FIG. 1 through FIG. 6.

FIG. 7 depicts components of a system 700 of locking assembly for firearm trigger safety mechanisms provided herein. System 700 comprises a trigger motor 701 for lock/unlock functionality, a trigger safety 702, and a trigger housing 703. These three components correspond to the motor 103, the safety 101, and the trigger 100, respectively, provided by the system 100 and depicted in at least FIG. 1 through FIG. 3.

The system 700 also provides and FIG. 7 also depicts a trigger bar 704, a cable 705, the aforementioned electronic module 706, and a light-emitting diode (LED) 707. Also provided and depicted are the aforementioned pistol grip 708, a trigger guard 709, a pistol frame 710, and a locking block 711.

The transceiver as described above is not specifically depicted in FIG. 7 but is a component of the electronics module 706 inside the pistol grip 708. The transceiver exchanges wireless messages with at least the mobile device in possession of the handgun owner. At least one processor with software may also be provided to process such messages.

The mobile device sends commands to the electronic module and also receives electronic messages from the electronic module regarding the handgun status. The mobile device may be a smartphone, smartwatch or other wearable device. The electronics module 706 also receives automatic instructions generated by the app 504 shown in FIG. 5 when the handgun is moved beyond a previously configured distance from the mobile device.

The transceiver in the electronics module 706 transmits instructions to the trigger motor 701 via the cable 705. In FIG. 7, the cable 705 can be seen extending from the electronics module 706 to the trigger housing 703 wherein the trigger motor 701 is embedded or attached. Along the way, the cable 705 supported by the locking block 711 and the trigger bar 704, non-moving parts that merely provide stability for the handgun and hold the cable securely in place.

While not explicitly depicted in FIG. 7, the cable 705 connects with the trigger motor 701, which controls the eccentric (also not shown in FIG. 7). The connection of the electronics module 706 via the cable 705 to the motor 701 allows the mobile device in possession of the handgun owner to remotely block and unblock the safety 702 via wireless commands to the electronics module 706.

The transceiver in the electronics module 706 sends instructions along the cable 705 to the trigger motor 701 which turns the eccentric. This action either unblocks or blocks the trigger safety 702 which consequently results, respectively, in allowing the trigger housing 703 to be pulled and the handgun discharged or results in preventing the trigger housing 703 from being pulled.

In the emergency scenario provided above wherein the handgun and the mobile device may both be lost or stolen, the transceiver may receive a message from an Internet web site or from a telephone having called a toll-free number. The transceiver may receive instructions to immediately disable the handgun which it accomplishes by sending a message along the cable 705 to the trigger motor 701. A tragedy may thus be averted.

Figure 8:
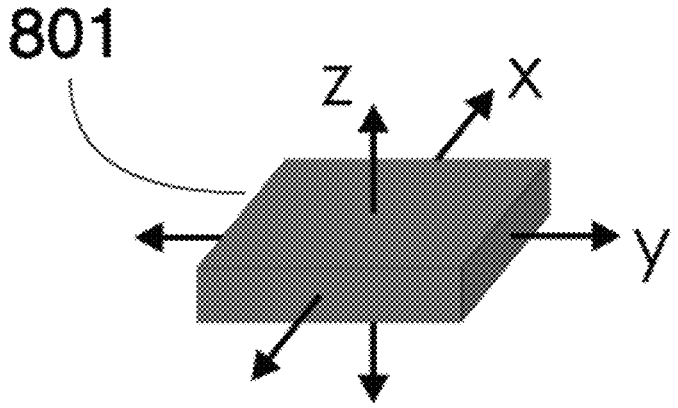
FIG. 8 is a diagram of an accelerator component of a locking assembly for firearm trigger safety mechanisms according to an embodiment of the present disclosure.

In addition to the transceiver, the electronics module 706 also includes an accelerometer which detects and reports movement of the handgun. When the trigger safety 702 is in locked position, the accelerometer contained within the electronics module 706 detects and reports movement on three axes X, Y and Z as shown in FIG. 8.

Figure 9:
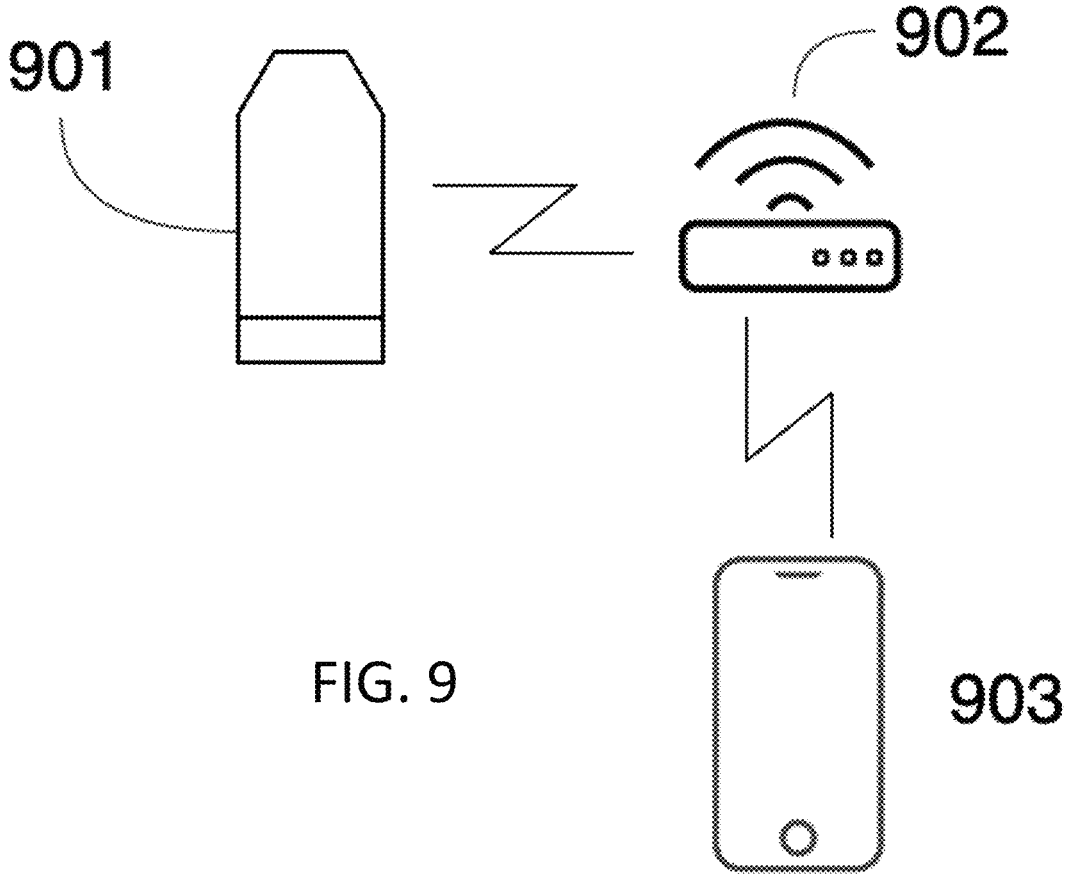
FIG. 9 is a diagram of an accelerator component and related components of a locking assembly for firearm trigger safety mechanisms according to an embodiment of the present disclosure.

In FIG. 9, the electronics module 901 maintains a connection with a WiFi router 902. If the handgun is locked and movement is detected via the accelerometer and the WiFi router is within range, an alert message is sent to the authorized user's mobile device (smartphone 903 in FIG. 9) via the internet connection managed and maintained by the router 902. The mobile device user can take action to secure the handgun.

The electronics module 706 also includes a light-emitting diode (LED) 707 on a visible exterior surface of the pistol grip 708. The LED 707 emits various color of light depending on the locked or unlocked status of the trigger safety 702. For example, when the trigger safety 702 is in locked status, the LED 707 may emit a green light and when the trigger safety is in unlocked status, the LED 707 may emit a red light. In an embodiment, the reverse may be true.

On or near a bottom surface of the pistol grip and near the LED 707 is a waterproof magnetic snap-on charger to recharge a battery or other power source for the electronics module 706. It is expected that the electronics module 706 will need only infrequent charging, for example on a monthly basis.

What is claimed is:

1. A system for improving firearm safety, comprising:
a firearm comprising:
a trigger for discharging the firearm;
a trigger safety member to prevent accidental discharging of the firearm; and
an electronic housing contained in a pistol grip of the firearm that:
receives a message from a mobile device,
determines that the message contains an instruction associated with an owner of the firearm, and
transmits, based on the instruction, a command regarding the trigger safety member to a motor that is embedded in the trigger that turns an eccentric component to one of block and unblock the trigger safety member.

2. The system of claim 1, wherein the electronic housing transmits the command along an internal cable to the motor.

3. The system of claim 2, wherein the system is configurable for the motor to turn the eccentric component to one of block and unblock the trigger safety member based on a detected distance between the mobile device and the firearm.

4. The system of claim 1, wherein the electronic housing receives the message via a transceiver component of the electronic housing.

5. The system of claim 1, wherein the electronic housing further comprises an externally visible LED indicating that the eccentric component is one of engaged and thereby blocks movement of the trigger safety member and disengaged and thereby allows movement of the trigger safety member.

6. The system of claim 1, wherein the electronic housing further comprises an accelerometer that detects when the firearm, while the trigger safety member is engaged, is physically moved.

7. The system of claim 6, wherein detected movement of the firearm results in transmission of a wireless message to the mobile device.

8. A method of remotely controlling a firearm safety mechanism, comprising:
a handgun receiving a wireless message;
the handgun verifying a source of the wireless message;
the handgun determining that the wireless message contains an instruction; and
the handgun, based on processing the instruction, transmitting a command via an internal cable to a motor embedded in a trigger of the handgun, the command instructing the motor to rotate an eccentric to one of block and unblock a trigger safety member.

9. The method of claim 8, further comprising an accelerator component stored in the handgun detecting movement of the handgun.

10. The method of claim 9, further comprising an electronic housing stored in the handgun transmitting a wireless alert based on the detection by the accelerometer component.

11. The method of claim 8, further comprising the handgun confirming that the source of the wireless message is a mobile device in possession of an owner of the firearm.

12. The method of claim 8, further comprising an electronic housing contained in a pistol grip component of the handgun comprising a transceiver component that receives the wireless message.

13. The method of claim 12, further comprising the electronic housing additionally comprising a light-emitting diode (LED), the LED displaying notifications regarding one of locked and unlocked status of the trigger safety member.

14. A system for detecting and reporting potential handgun danger, comprising:
a handgun;
a trigger for discharging the handgun;
a trigger safety member to prevent accidental discharging of the handgun; and
an electronic housing that:
receives a message from an accelerometer component,
determines, via a processor component, that the message indicates that the handgun has been moved, and
transmits, via a transceiver component, an alert regarding the movement of the handgun,
wherein the electronic housing further transmits instructions directing a motor that is embedded in the trigger to turn an eccentric component and one of block and unblock the trigger safety member.

15. The system of claim 14, wherein the electronic housing sends the alert to a WiFi router.

16. The system of claim 15, wherein the WiFi router sends a notification of the alert to a mobile device associated with an owner of the handgun.

17. The system of claim 14, wherein the electronic housing is situated in a pistol grip of the firearm and contains at least the accelerator component, processor, and transceiver components.

18. The system of claim 14, wherein the electronic housing transmits the alert when the trigger safety member is engaged and the trigger is thus blocked from discharging the handgun.

19. The system of claim 14, wherein the electronic housing additionally comprises an LED, the LED displaying notifications regarding one of locked and unlocked status of trigger safety member.

20. The system of claim 14, wherein the electronic housing further transmits instructions via an internal cable to the motor.

* * * * *